United States Patent [19]

Senor

[11] 4,376,926

[45] Mar. 15, 1983

[54] MOTOR PROTECTOR CALIBRATABLE BY HOUSING DEFORMATION HAVING IMPROVED SEALING AND COMPACTNESS

[75] Inventor: Ronald E. Senor, North Attleboro, Mass.

[73] Assignee: Texas Instruments Incorporated, Dallas, Tex.

[21] Appl. No.: 262,843

[22] Filed: May 12, 1981

Related U.S. Application Data

[63] Continuation of Ser. No. 52,897, Jun. 27, 1979, which is a continuation of Ser. No. 856,707, Dec. 2, 1977.

[51] Int. Cl.[3] ..... H01H 37/54

[52] U.S. Cl. ..... 337/104; 337/113; 337/368

[58] Field of Search ..... 337/104, 100, 102, 89, 337/82, 112, 113, 365, 368, 372, 360; 361/26, 32; 318/783

[56] References Cited

U.S. PATENT DOCUMENTS

| | | | |
|---|---|---|---|
| 3,104,296 | 9/1963 | Moksu et al. | 337/113 |
| 3,223,808 | 12/1965 | Wehl | 337/360 |
| 3,430,177 | 2/1969 | Audette | 337/89 |
| 3,443,259 | 5/1969 | Wehl et al. | 337/368 |
| 3,587,022 | 6/1971 | Hire | 337/89 |
| 3,602,862 | 8/1971 | D'Entremont | 337/104 |
| 3,902,149 | 8/1975 | Senor | 337/112 |

*Primary Examiner*—Harold Broome

*Attorney, Agent, or Firm*—James P. McAndrews; John A. Haug; Melvin Sharp

[57] ABSTRACT

A motor protector has a tubular metal housing with open and closed ends, has a contact welded to one inner side of the housing near the closed housing end spaced from an opposite inner side of the housing, has a terminal sealed in the open housing end, and has a bimetal member extending from the terminal into the housing along the housing axis in spaced insulated relation to the housing to move into and out of engagement with the contact in response to temperature change. The protector is compact and hermetically sealed and is calibratable by housing deformation without loss of hermetic sealing. In some embodiments first and/or second heaters connected to selected motor windings via sealed terminals are compactly accommodated in the housing along respective sides of the bimetal member.

8 Claims, 5 Drawing Figures

MOTOR PROTECTOR CALIBRATABLE BY HOUSING DEFORMATION HAVING IMPROVED SEALING AND COMPACTNESS

This is a continuation of Ser. No. 52,897, filed June 27, 1979, which was a continuation of application Ser. No. 856,707, filed Dec. 2, 1977.

Electrical motors which operate compressors in refrigerators and air conditioners and the like are commonly enclosed in shells together with selected coolants. Motor protector devices sealed to exclude the coolants are fitted inside the motor windings. Within such protectors, a thermally responsive member is arranged to be responsive to the winding temperature for moving contact means to open a circuit when the member is heated to a selected temperature. Usually a heater is disposed in heat-transfer relation to the thermally responsive member to be connected in series with the run winding of the motor for promptly heating the member to open the noted circuit when an overload current occurs in the run winding of the motor. Sometimes a second heater is disposed in heat-transfer relation to the thermally-responsive member to be connected to the start winding of the motor for opening the protector circuit when an overload current occurs in the start winding of the motor.

When such conventional motor protectors are considered for use in motors where both start and run winding heaters would be desirable to promptly deenergize the motors on the occurrence of overcurrent conditions in either of the motor windings, it is frequently found that the cost of the two-heater protector is excessive so that a protector having less satisfactory performance characteristics is used instead. This is partly due to the fact that the manufacture of such two-heater protectors is commonly characterized by relatively low yields because calibration of the protectors is performed before the final steps in manufacturing the protector are completed. In other cases where the two-heater type of motor protector would be desirable it is sometimes found that the two-heater device is not sufficiently compact to be readily accommodated in a motor winding where it can be directly responsive to increase in winding temperature. In some of those cases, a motor protector having less desirable performance characteristics is also used. In addition, it is frequently found that conventional two-heater types of motor protectors have poor shock-resistance and are easily thrown out of calibration during handling prior to use or when subjected to substantial shock forces during use. Further, where such conventional motor protectors are provided with a reasonably compact structure, it is sometimes found that the devices display fairly limited service lives due to arcing which occurs between the thermally responsive member and other components of the protector during opening and closing of the protector circuit.

It is an object of this invention to provide a novel and improved motor protector device; to provide such a device which is adapted to interrupt operation of a motor in response to the occurrence of an overload current in either the start or run winding of the motor; to provide such an improved motor protector which is of sufficiently compact construction to be readily accommodated within the winding of an electrical motor; to provide such a protector which is adapted for close thermal coupling to a motor winding to be directly responsive to over-temperature conditions occurring in the winding; to provide such a protector which is adapted to be shock resistant and to retains its calibration even when subjected to substantial shock forces; to provide such a protector which is adapted to be calibrated after final assembly and which is adapted to be manufactured with high manufacturing yield; to provide such an improved protector which displays a long service life; and to provide such a protector which is of rugged and inexpensive construction.

Briefly described, the novel and improved motor protector of this invention comprises a tubular housing of a deformable, electrically and thermally conductive metal material having an open end and a closed end. A first contact button is welded or otherwise secured directly to the housing inside the housing adjacent to the closed end of the housing. A header plate is secured to the open housing end for hermetically sealing the housing and a pair of terminal pins extend through the plate in sealed, electrically insulated relation to the plate to extend into the housing in spaced, electrically insulated relation to each other and to the housing. A first heater element is welded to one of the terminal pins to extend in cantilever relation to the pin along the length of the tubular housing. A thermally responsive snap-acting bimetallic member has one end welded to the first heater element and has a second contact at its opposite end, the bimetallic member extending in cantilever relation from the first heater element to normally dispose the second contact in engagement with the first contact adjacent the closed end of the housing for closing a circuit. The bimetallic member is adapted to be heated to a selected temperature for moving the second contact with snap action to disengage the first contact for opening the circuit. A portion of the first heater element which is at least co-extensive with the thermally-responsive bimetallic member extends along one side of the member between the member and the housing in close heat-transfer relation to the member. A second heater element is connected between the second terminal pin and the thermally responsive member and has a portion extending along the opposite side of the thermally responsive member in close heat-transfer relation to the member.

The motor protector housing is adapted to be connected to a terminal in a power circuit while the first and second terminal pins are connected to the run and start windings respectively of an electrical motor for normally energizing the motor windings through the protector circuit and for directing the run and start winding current through the respective first and second heater elements. Under normal motor operating conditions, the heaters generate insufficient heat to actuate the bimetallic member to open the protector circuit. However, on the occurrence of an overload current in either motor winding, the heaters generate sufficient heat to actuate the bimetallic member to open the circuit for protecting the motor against excessive winding temperature. The heater elements, bimetallic member and the contacts are arranged within the housing in such a way that the housing is adapted to be deformed adjacent the closed housing end after final assembly of the protector for calibrating the protector to open the protector circuit when the bimetallic member is heated to a desired temperature. The two heater elements, the bimetallic member and the contacts are accommodated in the housing in a very compact way to provide the protector with a compact structure which is easily fitted into a motor winding, the housing being of thermally conductive material for providing good thermal coupling between the winding and the thermally responsive bimetallic member, whereby the protector is adapted to be directly responsive to excessive increases in motor winding temperature for opening the protector circuit. The two heater elements and the thermally responsive member have a common polarity with the movable second contact so that no arcing occurs between those components during and opening and closing of the protector circuit even though those components are spaced closely together within the compact housing. On the other hand, the first heater element is at least co-extensive with the thermally-responsive member at a location between the member and the housing and therefore shields the bimetallic member against any arcs which might tend to form between the member and the metal housing. Further, because the first heater element and the thermally responsive member extend as a continuous cantilever unit to support the second contact while the mating contact is mounted directly on the housing, the internal structure of the protector has substantial rigidity and has significant position tolerance with respect to the housing so that the device is significantly less subject to loss of calibration when the protector is subjected to shock forces during handling or use.

Other objects, advantages and details of the novel and improved motor protector of this invention appear in the following detailed description of preferred embodiments of the invention, the detailed description referring to the drawings in which.

Figure 1:
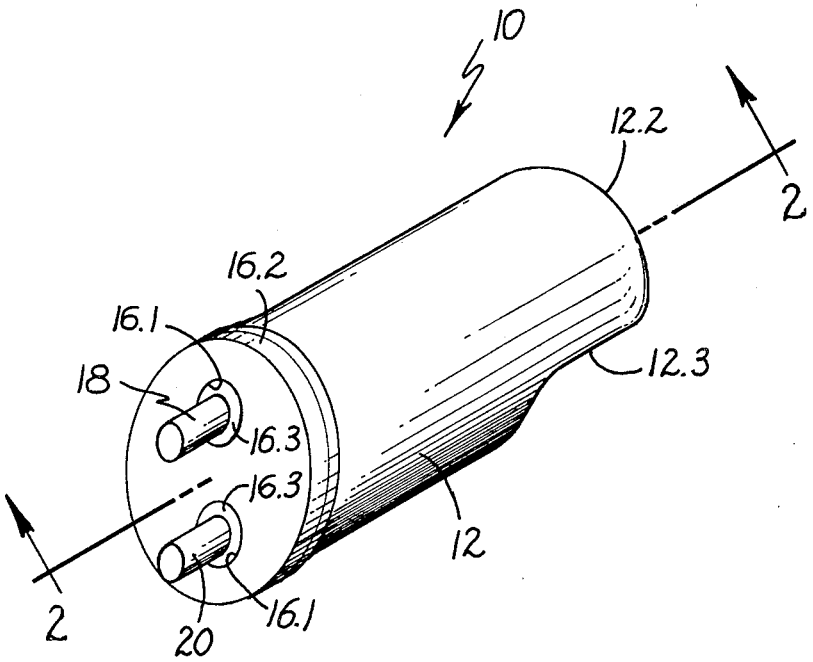
FIG. 1 is a perspective view of the motor protector of this invention.
Figure 2:
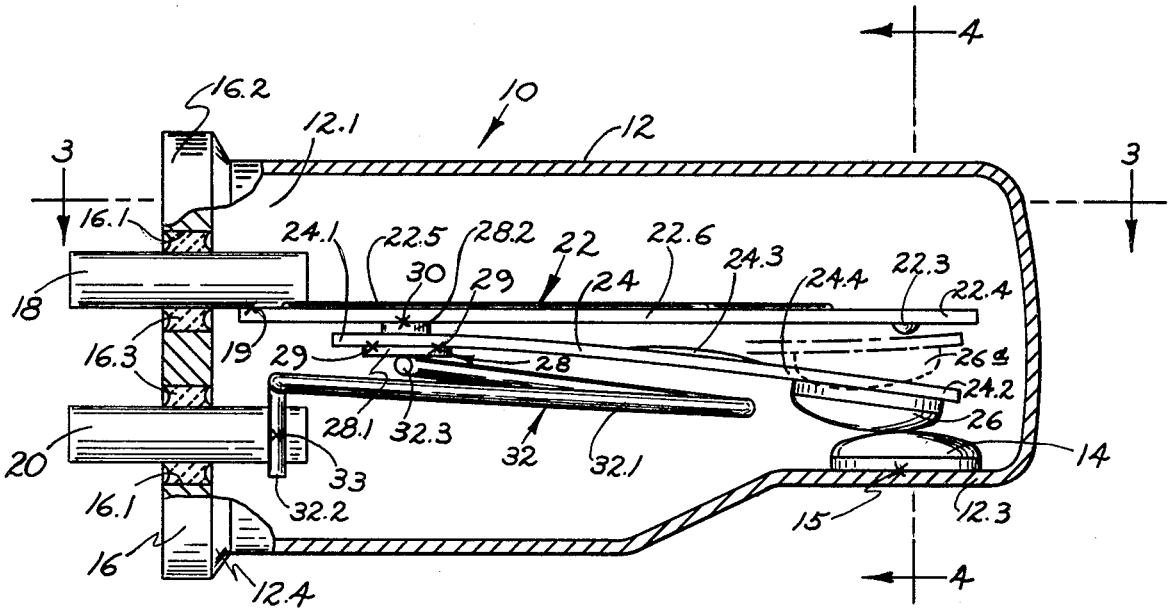
FIG. 2 is a section view to enlarged scale along line 2—2 of FIG. 1.
Figure 3:
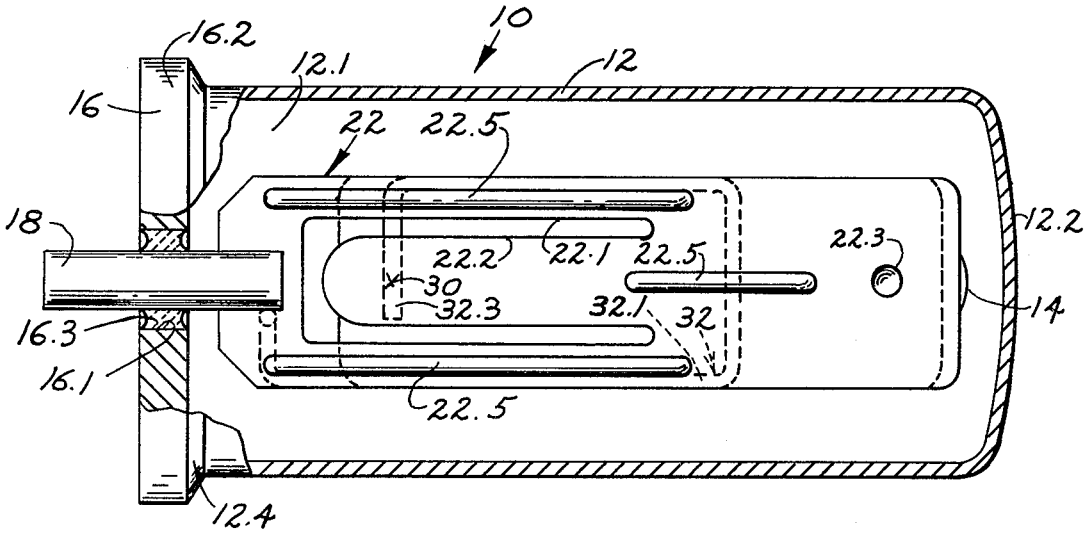
FIG. 3 is a section view along line 3—3 of FIG. 2.
Figure 4:
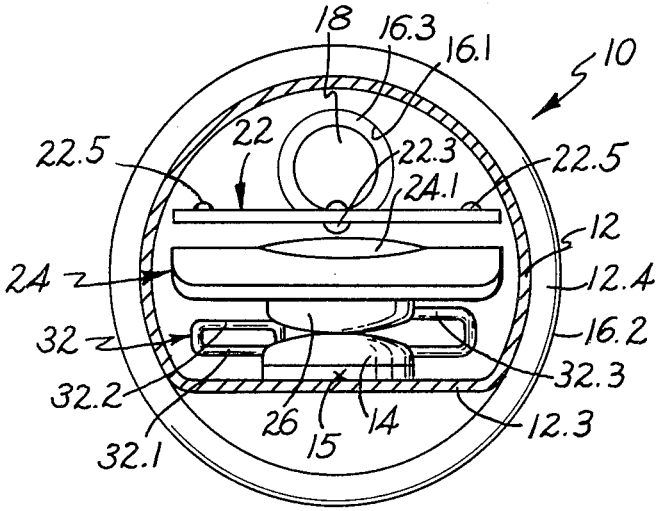
FIG. 4 is a section view along line 4—4 of FIG. 2.

Referring to the drawings, 10 in FIGS. 1–5 indicates the novel and improved motor protector of this invention which is shown to include a generally tubular housing 12 having an open end 12.1 and a closed end 12.2, the housing preferably having a stepped portion 12.3 adjacent the closed housing end. The housing is formed of a deformable, electrically and thermally conductive, metal material such as low carbon steel and preferably has a flared rim 12.4 adjacent its open end. A first, fixed contact button 14 of a material such as silver-backed silver-cadmium oxide or the like having a high electrical conductivity, low contact surface resistance, and good resistance to contact welding and arc erosion is welded or otherwise secured as indicated at 15 directly to the stepped portion 12.3 of the housing at one side of the housing adjacent to the closed housing end as is best shown in FIGS. 2 and 4. A header plate 16, also preferably formed of low carbon steel or the like has a pair of openings 16.1 therein and has its perimeter welded or otherwise secured to the housing at the open housing end for hermetically sealing the header plate to the housing. A pair of terminals pins 18 and 20, preferably formed with a copper core having a steel cladding thereon, are disposed in the respective header plate openings and are secured therein in hermetically sealed, electrically insulated relation to the header plate by conventional glass-sealing means or the like as indicated at 16.3 in the drawings, whereby the pins extend inside the protector housing. The spacing of the plate openings 16.1 from the perimeter of the plate is selected to assure that the glass seals are not damaged by welding of the plate perimeter to the housing.

In accordance with this invention, a first electrical resistance heater element 22 is welded or otherwise secured to one terminal pin 18 as indicated at 19 in FIG. 2 to extend in cantilever relation from the pin to extend longitudinally along a substantial part of the length of the tubular housing 12. The heater element is preferably formed of a suitably rigid, electrically conductive metal material such as cold rolled steel or the like having a desired electrical resistivity, whereby the heater element is adapted to generate a selected heat output in response to directing a selected level of electrical current through the element. As is best shown in FIG. 3, the first heater element 22 preferably has a cut-out or opening 22.1 therein defining a tongue 22.2 for a purpose to be described below. The element also has a dimple 22.3 therein adjacent its distal end 22.4 as shown in FIGS. 2–4. Preferably rib-shaped indentations 22.5 are formed in the heater element to impart a desired degree of rigidity to the element.

In accordance with this invention, a thermally responsive snap-acting bimetallic member 24 has one end 24.1 thereof secured to the first heater element 22 in any conventional manner so that the member extends in cantilever relation from the first heater to normally engage a second electrical contact 26, which is carried at the opposite or distal end 24.2 of the member, with the first contact 14 to close a circuit as illustrated in FIGS. 2 and 4. In this arrangement the member 24 cooperates with the heater 22 to define a substantial space between the member and heater and said one side of the housing 12. The second contact 26 is preferably formed of the same materials as the first contact 14. The thermally responsive member is of conventional type having layers of metal of relatively high and relatively low coefficients of thermal expansion bonded together and having a dished portion 24.3 therein, whereby the member is normally adapted to hold the contact 26 in engagement with the contact 14 to close a circuit but, when heated to a selected temperature, is adapted to invert its dished portion and to move the second contact with snap action to the position indicated by broken lines **26*a* in FIG. 2 to disengage the contact 14 for opening the noted circuit. Of course, when the member 24 is then subsequently cooled to a selected level below said selected temperature, the member is adapted to return to its original close circuit position with snap-action as will be understood. The thermally responsive member 24 is preferably secured to the first heater element by means of a conventional weld button 28 as shown in FIG. 2, such a button having a head 28.1 welded to the member as indicated at 29 and having a shank 28.2 which extends through an aperture (not shown) in the end 24.1 of the thermally responsive member and which is welded to the tongue 22.2 of the first heater as indicated at 30 in FIGS. 2 and 3**.

In accordance with this invention, the first heater element 22 has a portion 22.6 which extends along one side 24.4 of the thermally responsive member in closely spaced, heat-transfer relation to the member at a location between the member and an opposite side of the housing 12. The first heater is at least coextensive with the thermally responsive member as is best seen in FIG. 3 and preferably has its distal end 22.4 extending beyond the distal end 24.2 of the thermally responsive member to be relatively closer to the housing 12 than is the thermally responsive member when the member 24 is in its open circuit position. The securing of the heater to the terminal 18 and the securing of the member 24 to the tongue 22.2 of the heater cooperates with the cut-out 22.1 in the heater element to assure that there is a significant length of current path between the terminal and the thermally responsive member so that the heater 22 is adapted to generate substantial heat in response to current flow between the terminal and member. The dimple 22.3 in the first heater is located as shown in FIG. 2 to engage the thermally responsive member 24 as that member moves to the open circuit position indicated by the broken lines 26*a* in FIG. 2, thereby to serve as stop means for the circuit opening movement of the thermally responsive member to minimize bouncing of that cantilever mounted member as it moves with snap action to its open circuit position. The location of the heater end 22.4 closer to the housing 12 than the end 24.2 of the thermally responsive member shields the member against arcing to the housing.

In accordance with this invention, a second heater element 32 is disposed in the substantial space between the member 24 and heater 22 and said one side of the housing. The second heater is electrically connected between the second terminal pin 20 and the thermally responsive member 24 and has a portion 32.1 which extends along an opposite side 24.5 of the thermally responsive member in closely spaced heat-transfer relation to the member at a location between the member and the housing 12. Preferably, for example, the heater element 32 comprises a wire of nichrome alloy or the like having a selected electrically resistivity, the wire having one end 32.2 welded to the terminal pin 20 as indicated at 33 in FIG. 2 and having its opposite end 32.3 welded to the weld button 28 electrically connected to the thermally responsive member.

Figure 5:
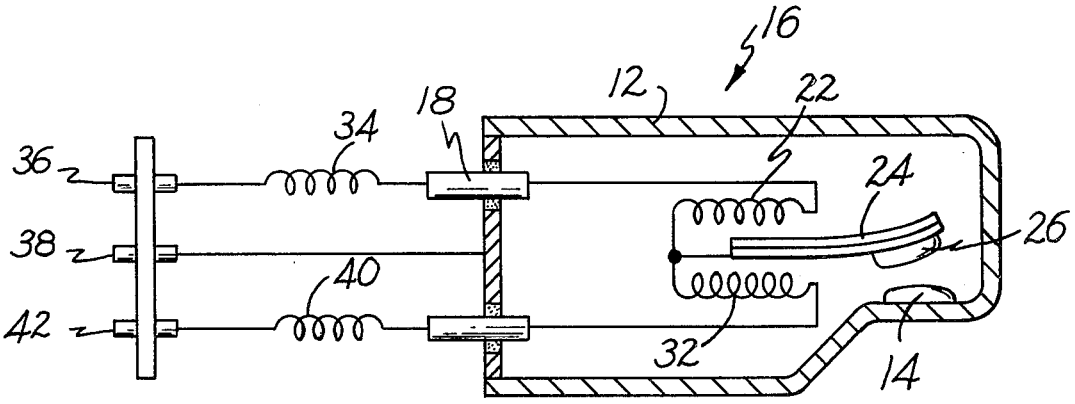
FIG. 5 is a schematic view illustrating use of the motor protector of this invention in protecting an electrical motor.

Operation of the motor protector 10 is illustrated in FIG. 5. That is, the protector terminal 18 is connected to the main or run winding 34 of an electrical motor inside a compressor shell or housing and the protector housing is connected to the common terminal 38 on the motor housing, thereby connecting the first heater element 22, the member 24, the contacts 14 and 26, and the housing 12 in series with the run winding between the run winding terminal and the common or ground terminal. The protector terminal 20 is connected to the start winding 40 of the motor inside the motor housing for connecting the second heater element 32 in series with the start winding between the start winding terminal 42 and common terminal on the motor housing. In this arrangement, when the motor terminals 36, 38 and 40 are connected to a power supply in conventional manner, the run winding of the motor is energized through the above-noted protector circuit while the contacts 14 and 26 are engaged and the run winding current is directed through the first heater 22. In normal operation of the motor the heater 22 does not generate sufficient heat to cause snap-acting movement of the thermally responsive member 24 to open the protector circuit. However, if an overload current occurs in the run winding of the motor due to a locked rotor condition of the like, the increased current in the heater 22 cooperates with the heat generated by the current flow in the member 24 to promptly open the protector circuit before the motor can be damaged by excessive temperature increase due to the increased current. In this way the protector 10 protects the run winding 34 against overcurrent conditions in that winding.

The start winding of the motor is also energized through the protector circuit, the start winding current being directed through the second heater 32. When the motor is initially energized, the start winding current is initially high and is then reduced in conventional manner after the start winding has completed its starting function. During the brief starting period, the heater 32 generates insufficient heat to cause movement of the thermally responsive member 24 for opening the protector circuit. However, if the start winding current is excessively high or continues high for an excessive period of time, due to welding of contacts in a starting relay or to short circuiting of a start capacitor for example, the heater 32 generates sufficient heat to move the member 24 for opening the protector circuit to protect the start winding.

The motor protector 10 is of very compact structure even though it accommodates two heater elements and is accordingly easily incorporated within a winding of the electrical motor. Further, the housing of the protector is formed of thermally conductive material. Therefore the protector is adapted to be directly responsive to slow build-up of temperatures in the motor windings such as might occur if the motor were subjected to small but sustained overloading for a substantial period of time.

The first and second heater elements of the protector have a common polarity with the thermally responsive member 24 and with the movable contact 26 of the protector. Accordingly the heaters and the thermally responsive member can be compactly spaced inside the protector housing without risk of arcing occurring between those components. The thermally responsive member has one side disposed in close heat transfer relation to the first heater element 22 so that the member is promptly responsive to the heat generated by the element 22. The cantilever arrangement of the thermally responsive member also provides substantial space for the second heater element 32 as noted above while disposing the second heater in close heat-transfer relation to the opposite side of the thermally responsive member. The thermally responsive member is preferably proportioned so that the contact 26 carried by the member engages the stationary contact 14 slightly off center toward the open end of the housing 12. Accordingly as arcing occurs between the contacts 26 and 14 during opening and closing of the protector circuit, any deflection of such arcing tends to be toward the closed end of the housing and away from the thermally responsive member 24. Further if such a deflected arc should tend to extend between the closed housing end and any of the components located inside the protector housing as the protector circuit opens, the first heater element 22 is spaced closer to the housing than is the thermally responsive member and shields the thermally responsive member 24 from such arcing. Thus the thermally responsive member retains its thermal response characteristics over a long service life after calibration.

In the protector 10, no welds are made to the header plate until final assembly of the housing 12. Thus welding of the heaters to the terminal pins is easily accomplished and the terminal pins are adapted to have sufficient length so that welds made to the pins have sufficient spacing from the glass-to-metal seals and do not have a deleterious effect on the glass-to-metal seals mounting the pins in the header plate. The first heater and the thermally responsive member also form a continuous cantilever support for the contact 26 to support that contact relative to the fixed contact 14 which is mounted directly on the housing 12. Thus, the position of the first heater 22 and the member 24 tend to remain constant and do not permit significant alteration of the position of the member 24 or the contact 26 when the protector is subjected to shock forces during handling or during use.

Thus, once calibrated, the device 10 tends to retain it calibration over a long service life. Further, because the cantilever components inside the housing are compactly arranged, substantial spacing tolerance can be provided between the cantilever components and the housing.

In addition, the protector 10 of this invention is adapted to be easily and reliably calibrated after assembly of the protector has been fully completed. That is, the protector is calibrated by deforming the housing 12 at the approximate location indicated by the arrow 48 in FIGS. 2 and 4, thereby to adjust the pressure engagement of the contacts 26 and 14 so that the thermally responsive member 24 is adapted to snap to open circuit position at a desired temperature and to return to closed circuit position at a desired temperature after cooling. Further, if the deformation of the housing at the location 48 should be greater than desired, housing deforming pressure is applied locally to the sides of the housing as indicated by the arrows 50 in FIG. 4 for back-adjusting the device calibration. However, although the housing 12 is locally deformable for calibration purposes, the generally cylindrical shape of the housing provides the device with substantial strength to withstand high pressures when used in sealed compressor motor shells and the like.

In summary, the motor protector 10 provides overcurrent protection for both start and run windings in a motor and also provides direct overtemperature protection for the windings. The protector accomplishes these advantageous results on a structure which is very compact and trouble-free which is very easily and reliably assembled and calibrated so that the device has significantly reduced unit cost, and which displays a long service life. Thus the protector is adapted for use in many applications where protectors of significantly less desirable performance characteristics had previously been used.

It should be understood that although particular embodiments of the motor protector of this invention had been described by way of illustrating this invention, the invention includes all modifications and equivalents of the disclosed embodiments falling within the scope of the appended claims.

I claim:

1. A protector for an electrical motor having start and run windings comprising a tubular housing of deformable, electrically and thermally conductive metal material having an open end and a closed end, first contact means on the housing inside the housing adjacent the closed housing end, a pair of terminal means to be electrically connected to the respective motor windings mounted in the open housing end to extend into the housing in spaced, electrically insulated relation to each other and to the housing, a first electrical resistance heater secured in electrically conductive relation to one of the terminal means to extend in cantilever relation therefrom along the length of the housing in spaced relation to the housing, a thermally responsive electrically conductive bimetallic member having one end secured in electrically conductive relation to said first heater to extend in cantilever relation therefrom with one side of the member extending in heat-transfer relation to a portion of said first heater, said member having second contact means at its opposite end normally engaged with said first contact means for closing a circuit and being movable when heated to a selected temperature for disengaging the second contact means from the first contact means to open said circuit, and a second electrical resistance heater electrically connected between the other terminal means and said thermally responsive member, said second heater having a portion thereof extending along an opposite side of the member in heat-transfer relation thereto, whereby said heaters are compactly arranged in heat-transfer relation to the thermally responsive member to be connected in series with the respective motor windings for opening said circuit in response to the occurrence of selected current conditions in either of the windings while permitting deformation of the housing adjacent said closed end thereof for calibrating the protector.

2. A protector for an electrical motor having start and run windings comprising a tubular housing of deformable, electrically and thermally conductive metal material having an open end and a closed end, a first contact button mounted directly on one side of the housing inside the housing adjacent the closed housing end a pair of terminals to be electrically connected to the respective motor windings mounted in the open housing end to extend into the housing adjacent to said one housing side and to an opposite side of the housing respectively in spaced, electrically insulated relation to each other and to the housing, a first electrical resistance heater secured in electrically conductive relation to the terminal adjacent said opposite housing side to extend in cantilever relation therefrom longitudinally along the length of the housing in spaced relation to the housing, a thermally-responsive electrically conductive bimetallic member having one end secured in electrically conductive relation to said first heater to extend in cantilever relation therefrom with one side of the member extending in heat-transfer relation to a portion of the first heater for cooperating with the first heater in defining a substantial space located between the member and first heater and said one side of the housing, said member having a second contact at its opposite end normally engaged with said first contact for closing a circuit and being movable when heated to a selected temperature for disengaging the second contact from the first contact to open said circuit, and a second electrical resistance heater disposed in said substantial space electrically connected between the other terminal and said thermally responsive member, said second heater having a portion extending along an opposite side of the member in heat-transfer relation to the member and in spaced relation to said housing, whereby said heaters are compactly arranged in heat-transfer relation to the thermally responsive member to be connected in series with the respective motor windings for heating the member to open said circuit in response to the occurrence of selected current conditions in either of the windings while permitting deformation of the housing adjacent said closed end thereof for calibrating the protector.

3. A protector as set forth in claim 2 wherein said portion of said first heater extending in heat-transfer relation to said one side of said thermally responsive member is at least coextensive with said member between the member and said opposite housing side, said first heater portion having a stop means thereon to engage said opposite end of the thermally responsive member when the member moves to open said circuit for limiting bouncing of the member during said circuit-opening movement and having an additional portion extending relatively closer to said closed housing end than is said opposite end of the thermally responsive member for shielding the member against arcing between said opposite member end and the housing during said circuit-opening movement.

4. A protector as set forth in claim 3 wherein said housing has a stepped portion on said one housing side adjacent said closed housing end which is relatively closer to said thermally responsive member than the remainder of said one housing side, said first contact button being mounted on said stepped housing portion.

5. A protector as set forth in claim 3 having a metal header plate with a perimeter and with a pair of openings, said terminals being mounted and hermetically sealed in the respective header openings with glass-to-metal seals, said heater plate having said perimeter welded to said open housing end with at least a selected spacing from said glass-to-metal seals for hermetically sealing the housing, and said heaters being welded to the respective terminals with at least said selected spacing from said glass-to-metal seals for electrically connecting the heaters to the terminals.

6. An hermetically sealed thermally and electrically responsive protector device comprising, a tubular housing of deformable electrically and thermally conductive metal material having an open end and a closed end, terminal means mounted in the open housing end to extend into the interior of the housing in spaced electrically insulated relation to the housing, first contact means forming a first circuit component, and thermally responsive electrically conductive bimetallic means forming a second circuit component, one of said circuit components being mounted on the terminal means inside the housing in electrically conductive relation to the terminal means and the other circuit component being mounted on a single inner side of the housing inside the housing spaced from an opposite inner side of the housing near the closed end thereof in electrically conductive relation to the housing so that the bimetallic means extends in cantilever relation along the longitudinal axis of the tubular housing which extends between said open and closed ends of the tubular housing, said bimetallic means carrying second contact means for movement between a closed circuit position engaging the first contact means and an open circuit position disengaged from the first contact means to provide a selected electrically insulating spacing between the circuit components in said open circuit position in response to selected temperature change, said housing being deformable for modifying the relationship of said contact means to each other to calibrate the device characterized in that said other circuit component is welded to said single inner side of the housing spaced from said opposite inner side of the housing, and sealing means mount said terminal means in the open housing end in hermetically sealed and electrically insulated relation to the housing, thereby to permit said selected electrically insulating spacing of said circuit components in said open circuit position while more compactly accommodating the circuit components in the housing interior and while assuring retention of that hermetic sealing during housing deformation for device calibration.

7. An hermetically sealed thermally and electrically responsive protector device comprising a tubular housing of deformable, electrically and thermally conductive metal material having an open end and a closed end and having first contact means mounted on a side of the housing inside the housing spaced from an opposite inner side of the housing adjacent the closed housing end, terminal means mounted in the open housing end to extend into the interior of the housing in spaced, electrically insulated relation to the housing, and thermally responsive electrically conductive bimetallic means having one end secured in electrically conductive relation to said terminal means to extend in cantilever relation therefrom into the housing along the longitudinal housing axis which extends between said open and closed ends of the tubular housing, said bimetallic means having second contact means at its opposite end movable between a first position engaged with said first contact means for closing a circuit and a second position disengaged from the first contact means to open said circuit in response to selected temperature change to provide a selected electrically insulating spacing between said contact means in said open circuit position, said housing being deformable for calibrating the protector characterized in that said first contact means is welded to said single inner side of the housing spaced from said opposite inner side of the housing, and glass-sealing means mount said terminal means in the open housing end in hermetically sealed and electrically insulated relation to the housing thereby to permit said selected electrically insulating electrical spacing of said contact means in said open circuit position while more compactly accommodating the contact means and bimetallic means in the housing interior and while assuring retention of that hermetic sealing during housing deformation for device calibration.

8. An hermetically sealed thermally and electrically responsive protector for an electrical motor comprising a tubular housing of deformable, electrically and thermally conductive metal material having an open end and a closed end and having first contact means mounted on a single inner side of the housing inside the housing spaced from an opposite inner side of the housing adjacent the closed end, terminal means to be electrically connected to a winding of the motor mounted in the open housing end to extend into the housing in spaced, electrically insulated relation to the housing, an electrical resistance heater secured in electrically conductive relation to the terminal means to extend in cantilever relation therefrom along the length of the housing in spaced relation to the housing, and a thermally responsive electrically conductive bimetallic member having one end secured in electrically conductive relation to said heater to extend in cantilever relation therefrom along the longitudinal housing axis which extends between said open and closed ends of the tubular housing with one side of the member extending in heat-transfer relation to a portion of said heater, said member having second contact means at its opposite end normally engaged with said first contact means for closing a circuit and being movable when heated to a selected temperature for disengaging the second contact means from the first contact means to open said circuit to provide a selected electrically insulating spacing between said contact means in said open circuit position, said housing being deformable adjacent said closed end thereof for calibrating the protector characterized in that said first contact means is welded to said single inner side of the housing spaced from said opposite inner side of the housing, and glass-sealing means mount said terminal means in the open housing end in hermetically sealed and electrically insulated relation to the housing thereby to permit said selected electrically insulating electrical spacing of said contact means in said open circuit position while more compactly accommodating the contact means and bimetallic means in the housing interior and while assuring retention of that hermetic sealing during housing deformation for device calibration.

* * * * *